US006540010B1

(12) United States Patent
Geerkens et al.

(10) Patent No.: US 6,540,010 B1
(45) Date of Patent: Apr. 1, 2003

(54) DEVICE FOR HYDRAULICALLY ADJUSTING THE ROLLERS OF STRAND GUIDING SEGMENTS OF A CONTINUOUS CASTING INSTALLATION

(75) Inventors: Christian Geerkens, Erkrath (DE); Ralf Hartmann, Düsseldorf (DE); Berthold Hild, Burbach (DE); Meinhard Watzlaw, Monheim (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/762,514

(22) PCT Filed: Aug. 13, 1999

(86) PCT No.: PCT/EP99/05944

§ 371 (c)(1),
(2), (4) Date: May 11, 2001

(87) PCT Pub. No.: WO00/09279

PCT Pub. Date: Feb. 24, 2000

(30) Foreign Application Priority Data

Aug. 14, 1998 (DE) ..... 198 36 843

(51) Int. Cl.[7] ..... F15B 11/08; B22D 11/16

(52) U.S. Cl. ..... 164/413; 164/454; 164/442; 91/361; 91/454; 91/459

(58) Field of Search ..... 91/361, 454, 459, 91/462, 512, 522; 164/454, 484, 442, 413

(56) References Cited

U.S. PATENT DOCUMENTS

| | | | | | |
|---|---|---|---|---|---|
| 3,954,046 | A | * | 5/1976 | Stillhard | 91/361 |
| 4,416,187 | A | * | 11/1983 | Nystrom Per H. G. | 91/361 |
| 5,678,470 | A | * | 10/1997 | Koehler et al. | 91/516 |
| 5,960,695 | A | * | 10/1999 | Aardema et al. | 91/454 X |
| 6,131,500 | A | * | 10/2000 | Moncrief | 91/361 |
| 6,209,619 | B1 | * | 4/2001 | Morwald et al. | 164/413 |
| 6,216,769 | B1 | * | 4/2001 | Wetter et al. | 164/413 |

FOREIGN PATENT DOCUMENTS

| | | | | |
|---|---|---|---|---|
| DE | 3835010 | | 4/1990 | |
| DE | 196 27 336 C1 | | 9/1997 | |
| GB | 2226290 A | * | 6/1990 | B22D/11/16 |

* cited by examiner

*Primary Examiner*—Edward K. Look
*Assistant Examiner*—Igor Kershteyn
(74) *Attorney, Agent, or Firm*—Friedrich Kueffner

(57) ABSTRACT

A device for hydraulic adjustment of rollers of strand guiding segments of a strand casting device has hydraulic cylinders which are separated by a piston with piston rod into a cylinder chamber and an annular cylinder chamber, respectively. The cylinder chambers can be connected by control members alternatingly and in opposite directions as well as simultaneously with a pressure source and a pressure sink, wherein on-off valves are provided as control members.

3 Claims, 4 Drawing Sheets

DEVICE FOR HYDRAULICALLY ADJUSTING THE ROLLERS OF STRAND GUIDING SEGMENTS OF A CONTINUOUS CASTING INSTALLATION

BACKGROUND OF THE INVENTION

1. Field of the Invention

The present invention relates to a device for hydraulically adjusting components, in particular, rollers of strand guiding segments of a continuous casting installation, comprising hydraulic cylinders which are separated by a piston with piston rod into a cylinder chamber and an annular cylinder chamber, respectively, wherein the cylinder chambers can be connected by control members alternatingly and in opposite directions as well as simultaneously with a pressure source and a pressure sink.

2. Description of the Related Art

In continuous casting installations the casting process begins in a casting mold. The surficially solidified casting strand exits from the mold vertically and is deflected by 90° in strand guiding segments having a certain radius and is guided to a horizontal straightening driver arranged downstream. The guiding of the casting strand is realized by guiding rollers which can be adjusted by hydraulic cylinders. Accordingly, it is possible to consider, inter alia, roll wear and changed casting parameters. For controlling the hydraulic cylinder, in general, proportional servo valves are used. They require microfine-filtered hydraulic oil as a result of their precise fit. The expenditure in regard to oil filtering is significant. Moreover, there is always a fire danger in connection with hydraulic oil in a casting machine and rolling mill area.

SUMMARY OF THE INVENTION

The invention has the object to provide a hydraulic system for adjusting continuous strand guiding segments which has a comparatively minimal requirement with regard to the purity of the working liquid and the minimal fire danger.

The object is solved in that as control members on-off valves are provided. On-off valves are either closed or open while proportional servo valves can also be in any intermediate position. Accordingly, on-off valves can withstand coarse dirt particles without clogging, while the possible opening of a proportional servo valve requires a clean working medium in order to prevent seat soiling. Moreover, in contrast to the proportional servo valves, the valve pistons of the on-off valves do not require precise fit because in the open state they are centered on a stop and in the closed state on the seat. Accordingly, the requirement with regard to purity and, moreover, to the lubrication action of the working fluid in the case of on-off valves is significantly lower than in the case of proportional servo valves. This means a reduced expenditure for filtering and the problem-free use of water-oil emulsions as a working liquid. In addition to the reduced expenditure for the on-off valves and for the type as well as the cleaning of the working liquid, the fire safety is a decisive advantage of the solution according to the invention.

By arrangement of four on-off valves in a full bridge circuit, a simple guiding and minimal length of the hydraulic lines with corresponding minimal installation expenditure are achieved.

It is also advantageous that the on-off valves are controllable by a three-step controller. The three-step controller operates only with the positions plus, minus, and zero. In the plus position, one of the on-off valve pairs is excited, in the minus position the other one, while in the zero position both on-off valve pairs are without current and thus closed. This results in a simple control configuration.

Since the on-off valves have a throttle, an adjustment of the piston position without overswinging can be realized despite the fully open on-off valves.

It is also advantageous when the on-off valves can be controlled by pulse width modulation. While in the three-step control the opening time interval of the on-off valves as a whole can be varied, the number of constant, short opening intervals is variable in connection with the pulse width modulation (variable pulse-duty factor). This is realized, similar to the three-step control, by means of discrete switching signals of a separate electronic hardware or by means of software of a computer. This optimizes the pulse-duty factor in the direction of switching frequency reduction. In the pulse width modulation, as in the case of the three-step control, an outlet on-off valve and an inlet on-off valve are always controlled at the same time since the inflow volume of one cylinder chamber corresponds always to the outflow volume of the other one.

It is moreover advantageous that each piston is connected by means of a connecting rod with a position transducer which triggers the control when the piston position surpasses an upper or a lower limit value. The position transducer allows a closed control circuit for the piston position. In this connection, a simple configuration and a simple startup of the three-step controller results based on the determination of hysteresis of the permissible piston position by an upper and lower limit value thereof.

Since the four on-off valves are combined to an on-off valve block, a space-saving, cost-efficient configuration of the on-off valves is provided.

BRIEF DESCRIPTION OF THE DRAWINGS

Further features of the invention result from result from the claims, the subsequent figure description and the drawings, in which embodiments of the invention are schematically illustrated.

It is shown in.

DESCRIPTION OF PREFERRED EMBODIMENTS

Figure 1:
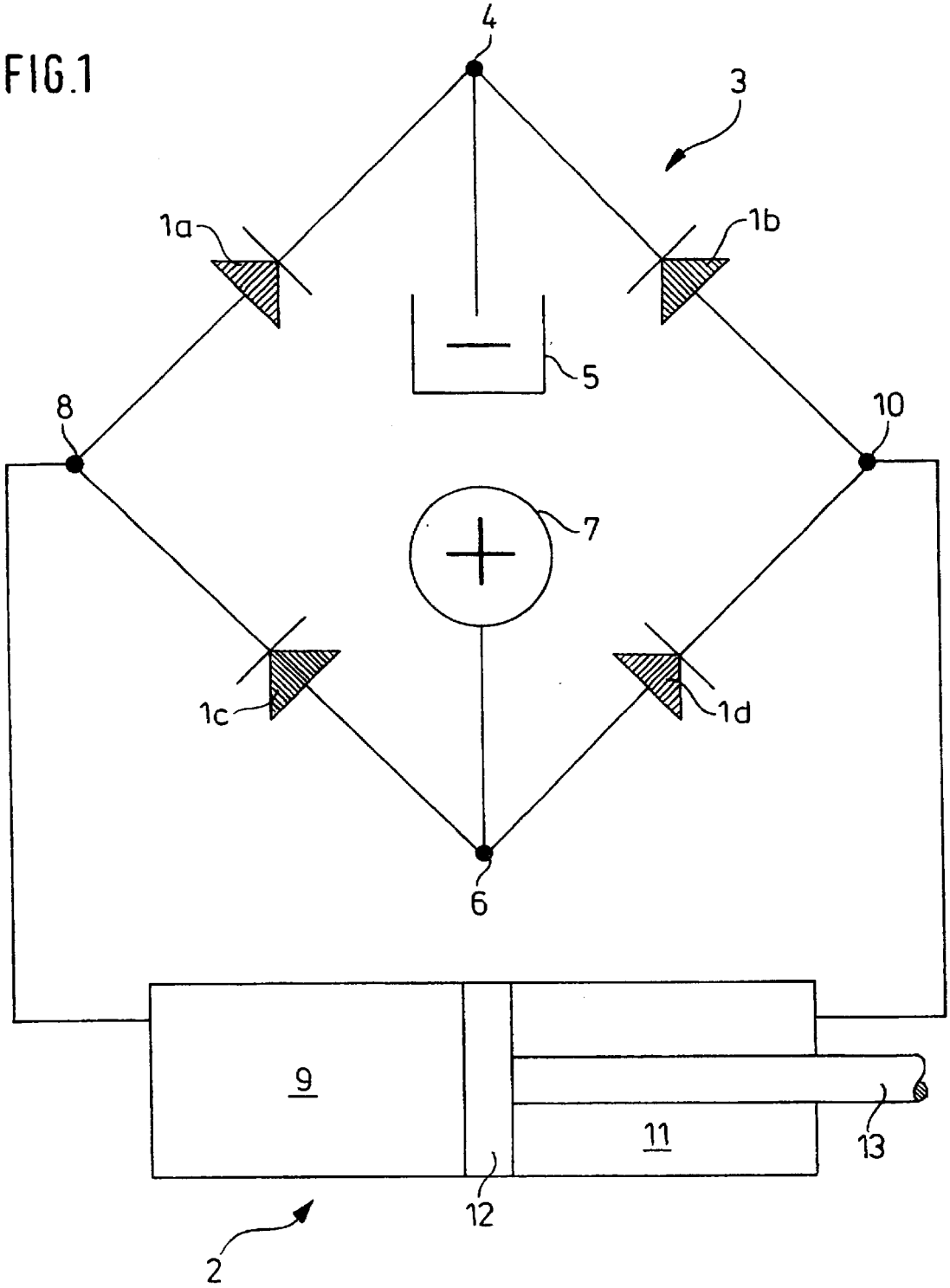
FIG. 1 a circuit diagram of the bridge circuit of the hydraulic oil circulation of a hydraulic cylinder.

FIG. 1 shows the on-off valves (1*a, b, c, d*), connected in a bridge circuit, of the hydraulic circuit of a hydraulic cylinder (2) which are combined to a valve block (3). The on-off valves (1*a, b*) can be connected via a first connecting point (4) with a pressure sink (5), the on-off valves (1*c, d*) via a second connecting point (6) with a pressure source (7). The on-off valves (1*a, c*) are connected moreover via a third connecting point (8) with a cylinder chamber (9), the on-off valves (1*b, d*) via a fourth connecting point (10) to an annular cylinder chamber (11) of the hydraulic cylinder (2). The cylinder chamber (9) and the annular cylinder chamber (11) are seal-tightly separated by a piston (12). The piston has a piston rod (13) projecting from the annular cylinder chamber (11). FIG. 1 shows the very compact configuration of the valve block (3) which is realized with minimal expenditure.

Figure 2:
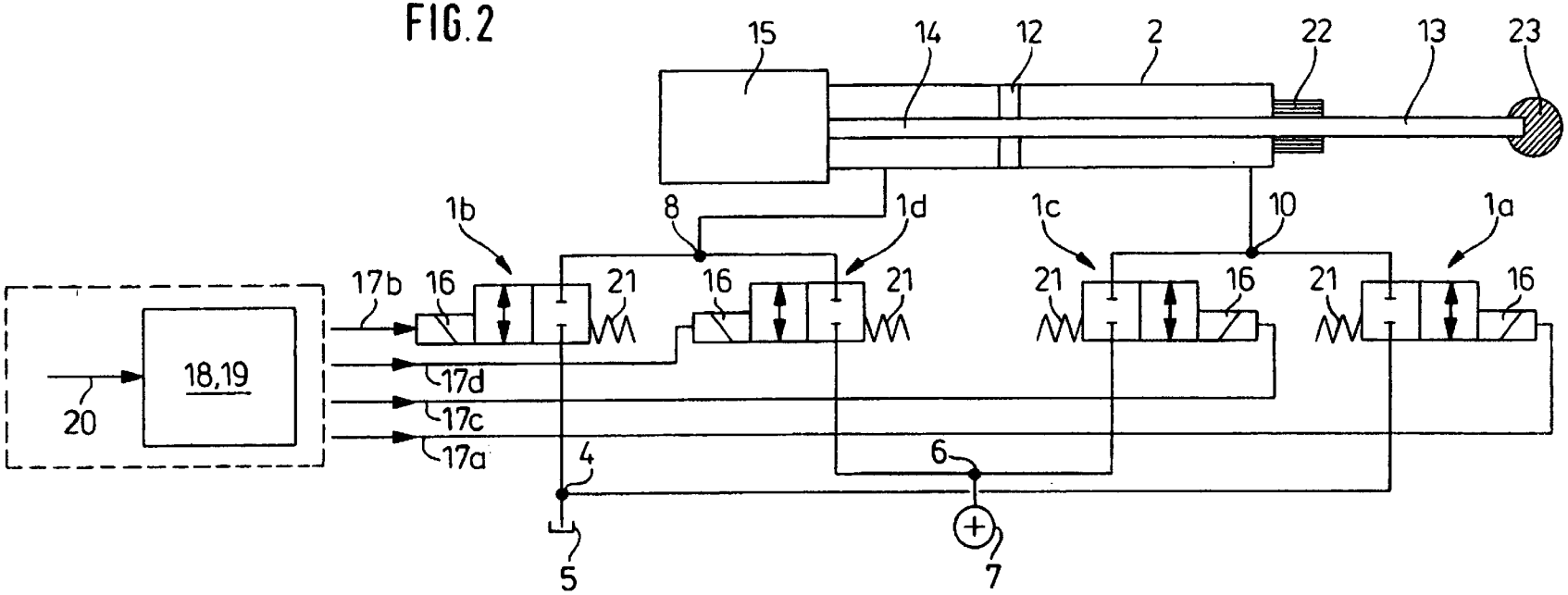
FIG. 2 a circuit diagram of the hydraulic oil circulation and the control of the on-off valves of a hydraulic cylinder.

In FIG. 2, a valve block with a hydraulic cylinder (2) and a simplified illustration of the electric control of the on-off valves (1*a, b, c, d*) are illustrated. FIG. 2 shows also the connecting points (4, 6, 8, 10) for connecting the on-off valves (1*a, b, c, d*) with the pressure sink (5) and the pressure source (7), the cylinder chamber (9) as well as the annular cylinder chamber (11). The piston (12) is connected by a connecting rod (14) with a position transducer (15) which indicates the respective position of the piston (12) relative to the hydraulic cylinder (2). Each one of the on-off valves (1*a, b, c, d*) has a solenoid (16) which is connected via electric lines (17*a, b, c, d*) with a three-step controller (18) or a pulse width modulator (19). The three-step controller (18) and pulse width modulator (19) are realized as electronic hardware or integrated as software in a computer (20). The on-off valves (1*a, b, c, d*) have springs (21) which effect their closing when the solenoid (16) is without current. The piston rods (13) are sealed by glands (22) which also serve for supporting the hydraulic cylinders (2) on one half of the strand guiding segments (35, FIG. 4). They support on their free ends a swivel head (23) for connecting them with the other half of the strand guiding segments (35).

Figure 3:
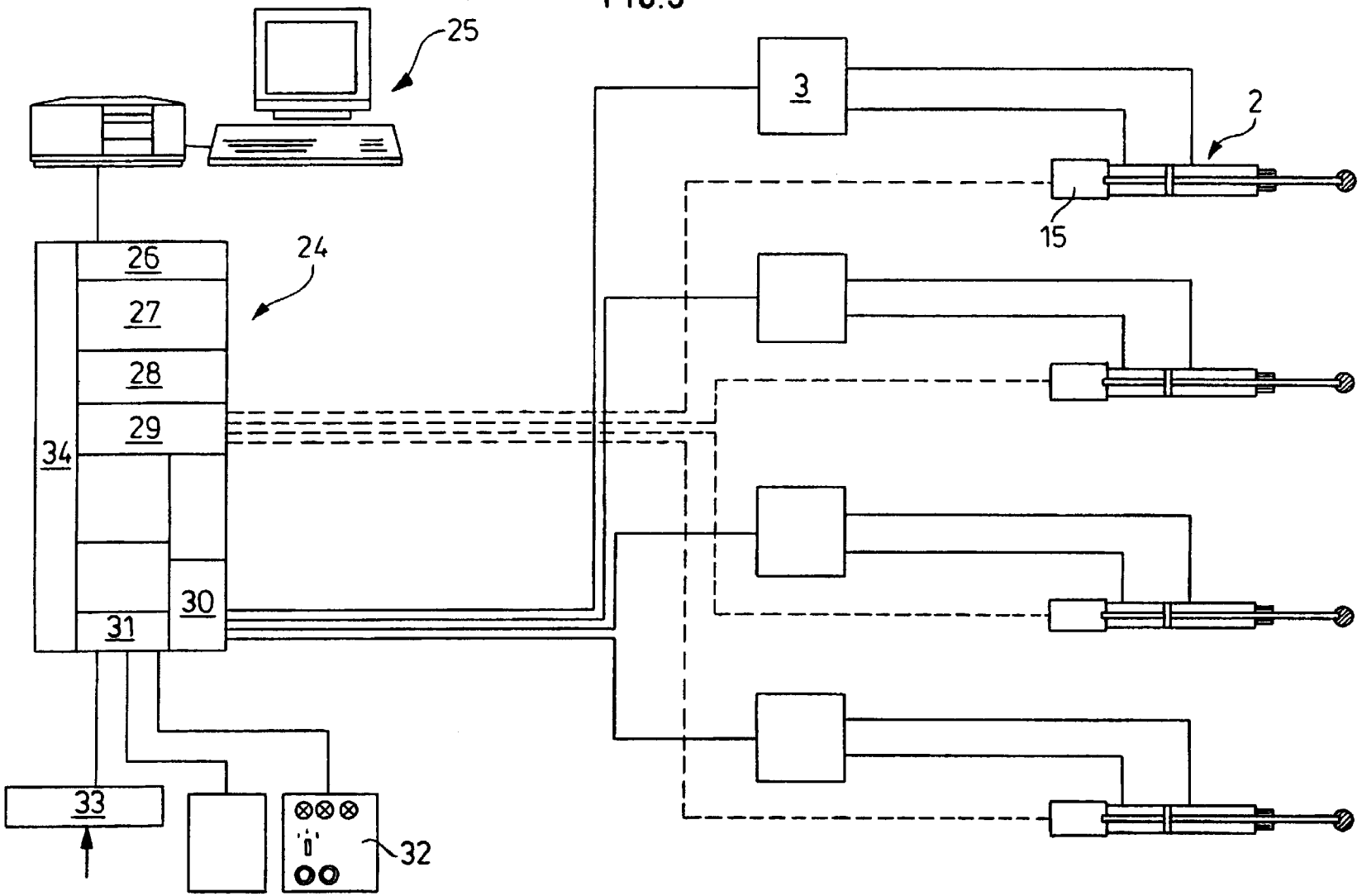
FIG. 3 a simplified circuit diagram of the hydraulic oil circulation and the control of the on-off valves of the four hydraulic cylinders of a strand guiding segment.
Figure 4:
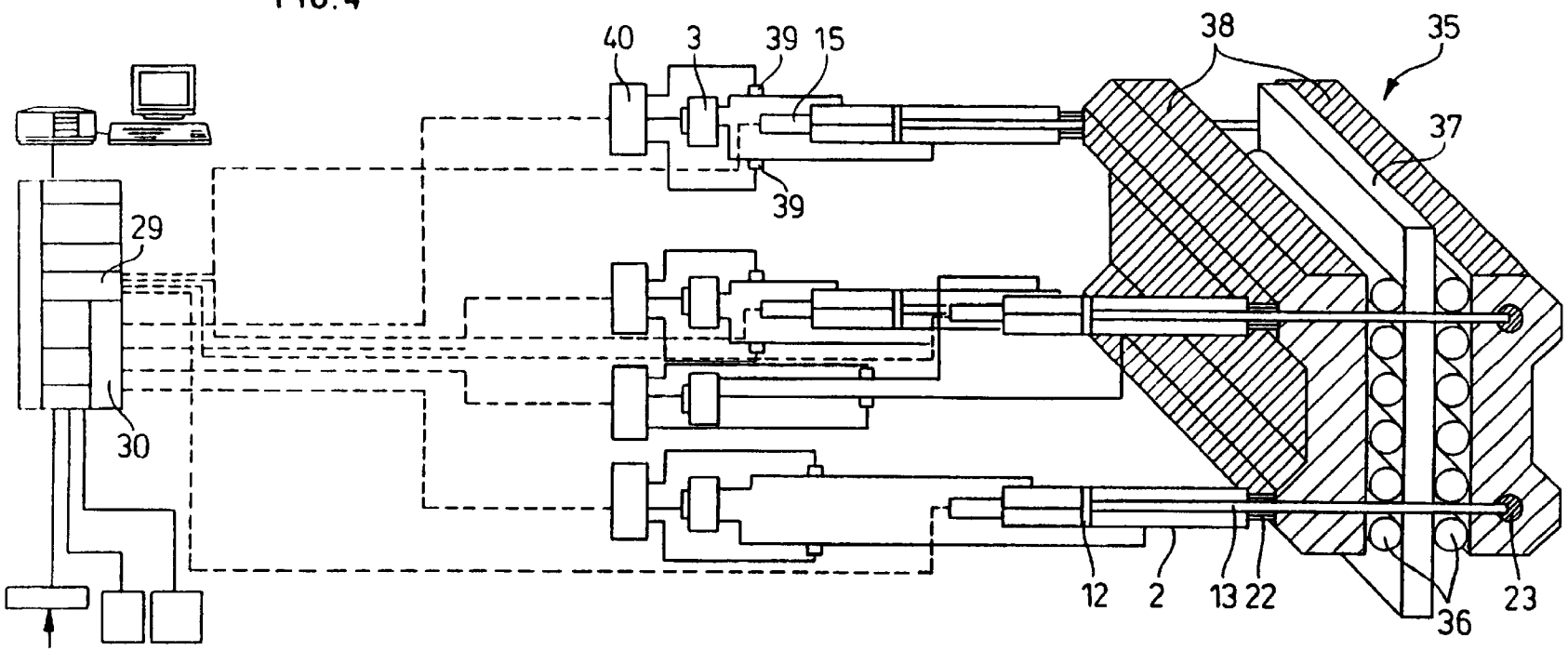
FIG. 4 like FIG. 3, but with perspective illustration of a strand guiding element.

FIG. 3 shows a simplified circuit diagram of the hydraulic oil circulation and the control of the valve blocks (3) for the four hydraulic cylinders (2) of a strand guiding segment (35, FIG. 4). In the same way, it is also possible to adjust leveling machines and saws. A switch cabinet (24) is connected with a computer whose software controls the on-off valve blocks (3) by means of three-step controllers or pulse width modulation. The switch cabinet (24) has inter alia a network card (26), a central processing unit (CPU) (27), a memory (28), an interface (29), for example, a SSI interface for establishing a connection to the position transducer (15), a digital/analog converter or switching amplifier (30) for the on-off valve signals, a digital input/output (31) for a control panel (32) on site and for a strip terminal (33) for connecting the signals of the device; in addition, a mains supply circuit (34) is provided.

FIG. 4 shows basically the same as FIG. 3 but with a strand guiding segment (35) in a perspective illustration. The latter has rollers (36) between which the cast strand (37) to be guided is positioned. The rollers have supports (38). The latter are adjusted by the hydraulic cylinders (2) and the pistons (12) by means of the piston rod (13). Pressure transducers (39) for monitoring the process are mounted in the hydraulic lines between the on-off valve blocks (3) and the hydraulic cylinders (2). Their signals are collected together with the signals of the on-off valve block (3) in an input/output component (40) and transmitted to the digital/analog converter (30). The signals of the position transducer (15) are then transmitted to the interface (29).

The device according to the invention functions as follows. When the position transducer (15) shows a deviation from the nominal position of the rollers (36), the nominal position is adjusted again, once a certain upper or lower limit value is surpassed, by controlling the corresponding on-off valves (1*a, b, c, d*) via three-step control or pulse width modulation.

By employing the on-off valves instead of proportional servo valves a water/oil emulsion can be used as the working liquid so that the fire danger in the case of leakage is reduced. Moreover, a microfine filtration of the working liquid is no longer needed so that the device according to the invention is less expensive with regard to initial installation cost and operation.

What is claimed is:

1. A strand guiding segment (35) of a strand casting device with rollers (36) between which a cast strand (37) is guided, wherein the rollers (36) are configured to be moved toward one another by supports (38), the strand guiding segment (35) comprising:

at least four hydraulic cylinders (2) with pistons (12) and piston rods (13) configured to move the supports (38);

four on-off valves (1*a, b, c, d*), connected in a full bridge circuit and combined in a valve block (3), provided for each one of the hydraulic cylinders (2) for advancing the hydraulic cylinders (2);

a computer (25) having a software for controlling the on-off valves by pulse width modulation or three-step control;

pressure sensors (39) arranged in hydraulic lines between the valve blocks (3) and the hydraulic cylinders (2);

position transducers (15) connected to the pistons (12);

a switch cabinet (24) connected to the computer and configured to receive signals, generated by the pressure sensors (39), the position transducers (15) and the valve blocks (3), and to send the signals received to the computer (25).

2. The strand guiding segment according to claim 1, wherein the on-off valves (1*a, b, c, d*) have a throttle.

3. The strand guiding segment according to claim 1, wherein each piston (12) is connected by a connecting rod (14) to the correlated position transducer (15) which triggers the control after surpassing an upper or lower limit value of the piston position.

* * * * *